US005423154A

United States Patent [19]

Maylon et al.

[11] Patent Number: 5,423,154

[45] Date of Patent: Jun. 13, 1995

[54] BANDING BEAD

[75] Inventors: Gary J. Maylon, Pinson; John D. Straub, Pell City, both of Ala.

[73] Assignee: Alabama Metal Industries Corporation, Birmingham, Ala.

[21] Appl. No.: 8,537

[22] Filed: Jan. 25, 1993

[51] Int. Cl.[6] ..... E04F 19/02; E04F 21/02

[52] U.S. Cl. ..... 52/371; 52/364; 52/717.05; 52/717.06; 52/730.2; 52/729; 52/731.7; 52/738

[58] Field of Search ..... 52/371, 364, 367, 352, 52/354, 344, 729, 709, 718.01, 717.05, 717.06, 730.2, 731.1, 731.7, 737, 738

[56] References Cited

U.S. PATENT DOCUMENTS

| | | | |
|---|---|---|---|
| Re. 24,658 | 6/1959 | Hollister | 52/371 X |
| 1,204,955 | 11/1916 | Day | 52/364 |
| 1,673,971 | 6/1928 | Dowell | 52/371 X |
| 1,679,914 | 8/1928 | Murray | 52/352 X |
| 2,114,048 | 4/1938 | Davis | 52/483 |
| 2,142,305 | 1/1939 | Davis | 52/589 |
| 2,272,162 | 2/1942 | Lackey | 52/367 X |
| 3,192,577 | 7/1965 | Barr | 52/364 |
| 3,331,176 | 7/1967 | Washam | 52/371 |
| 3,568,391 | 3/1971 | Conway | 52/364 X |
| 3,667,174 | 6/1972 | Arnett | 52/364 X |
| 4,353,192 | 10/1982 | Pearson et al. | 52/729 X |
| 4,364,212 | 12/1982 | Pearson et al. | 52/729 X |
| 4,785,601 | 11/1988 | Tupman | 52/364 |
| 5,081,814 | 1/1992 | Singletary et al. | |

OTHER PUBLICATIONS

"Metal Lath Building Products-AMICO-West".

"AMICO—Metal Lath Building Products, Accessories and Partition Systems".

*Primary Examiner*—Carl D. Friedman

*Assistant Examiner*—Robert J. Canfield

*Attorney, Agent, or Firm*—Trexler, Bushnell, Giangiorgi & Blackstone, Ltd.

[57] ABSTRACT

A banding bead which is attachable to a base structure for providing a guide and form for retaining plaster or other plastic materials thereagainst at two different heights. The banding bead includes a base portion and a generally planar elongated support segment extending generally perpendicularly away said base portion. The banding bead is extruded from a selected material or formed from a strip of sheet material. The support segment has a first planar side, a second planar side, and a top screed portion distal the base portion. A screed lip is disposed on the second planar side between the top screed portion and the base portion. The base portion includes primary and secondary feet extending from the support segment for attachment to the underlying base structure and to provide stability. The screed lip provides a screed surface for maintaining a desired wall thickness relative to a main wall plane and the top screed portion provides a screed surface for the surface of the banding feature a distance above the main wall plane.

19 Claims, 1 Drawing Sheet

FIG. 1
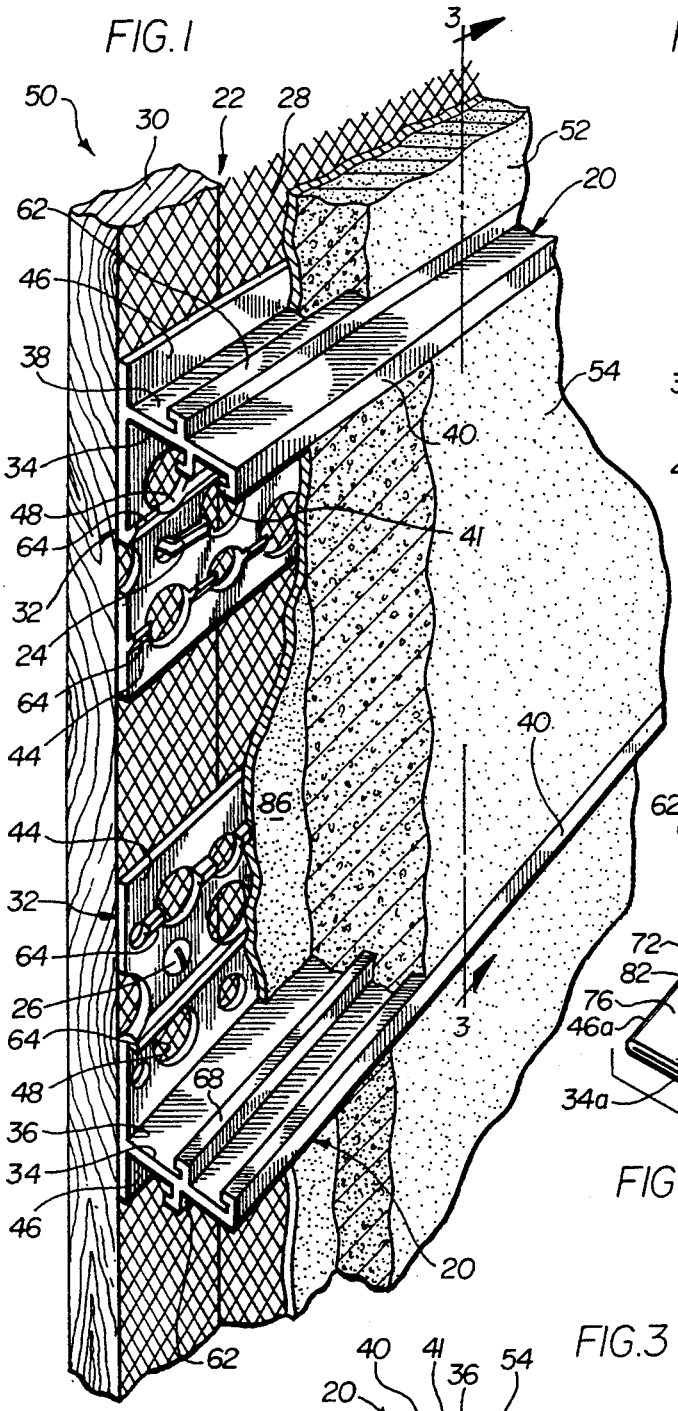
FIG. 2
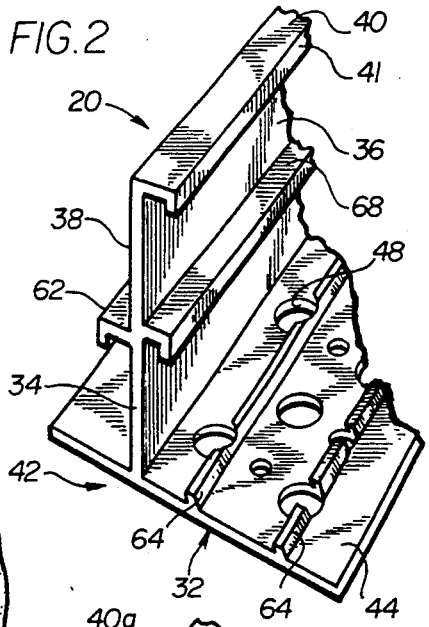
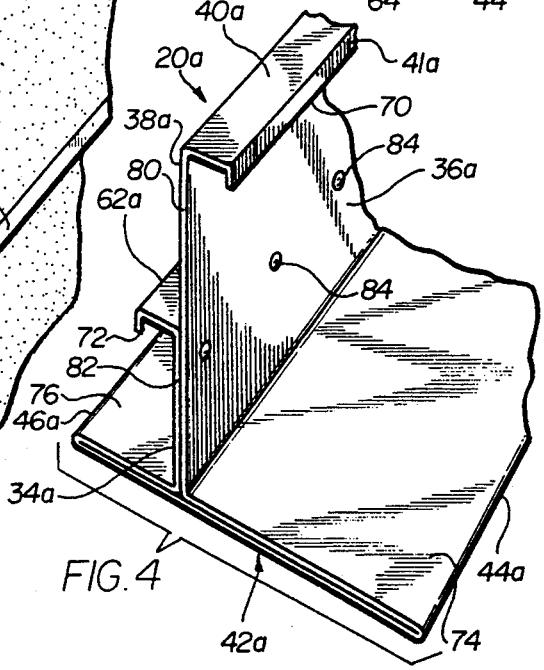
FIG. 4
FIG. 3
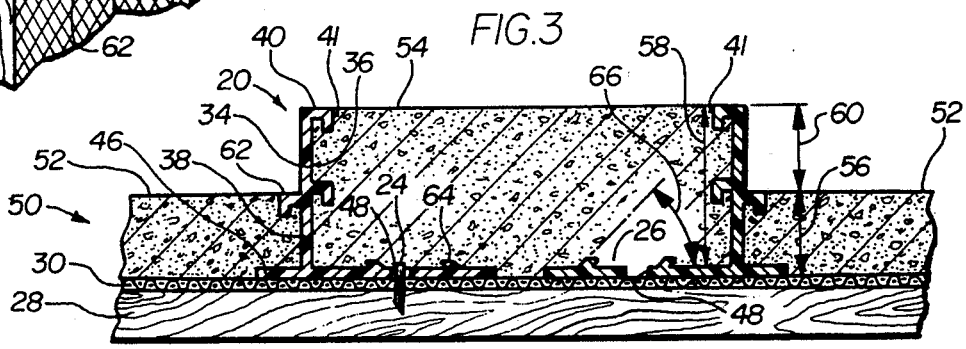

BANDING BEAD

BACKGROUND OF THE INVENTION

The present invention relates to lath and plastic building material accessories. More particularly, the present invention relates to a banding bead which allows plastic materials such as plaster to be maintained at two different levels when shaped against features of the banding bead.

Plaster, cement, and other plastic or stucco type building materials are very popular for internal and external architectural application. This material is very desirable for providing a variety of surfaces and achieving a variety of architectural designs. The versatility of the material and techniques are being used, with increasing popularity, to create architectural designs for structures ranging from commercial, to residential, to industrial.

Well known plastering or stuccoing techniques involve constructing a base structure or frame upon which lath and successive layers of plastic materials, such as plaster, are applied. For example, an underlying base structure formed of structural studs is provided and lath material is attached to these studs. The lath material may be an expanded metal product such as is shown in U.S. Pat. No. 5,081,814 to Singletary et al., issued Jan. 21, 1992. After the lath material is attached to the structural frame, a base of plaster material is applied to the lath. After a sufficient period of time, a "brown coat" is applied over the base coat. Later a "finish coat" is applied over the brown coat. Through practice and artistry, a craftsman employing the stuccoing techniques can achieve many types of architectural details.

One particular architectural detail is a banding structure which is desirable to break up the monotony of a planar wall. Banding may be oriented vertically or horizontally or any other direction as desired. Additionally, a curved band could be formed to achieve a nonlinear effect. Other uses for the banding feature might be, for example, to frame a commercial sign or highlight some other architectural detail.

The banding feature is achieved by forming the plaster material at two different levels over a defined band or strip along the wall or surface. For example, with reference to a planar wall, a horizontal band can be formed by building up plaster on top of, or above the main plane of the wall, so that plaster within the horizontal band area projects away from the main plane of the wall. Dimensions for such a band are commonly three-quarters to one inch above the main plane of the wall.

To achieve the banding effect, craftsmen use a lath accessory known as "casing bead". The casing bead is an accessory which includes an L-shaped rigid portion. A vertical leg of the L-shaped portion extends a desired distance away from the wall and the horizontal leg of the L-shaped portion is attached to the lath material and/or the base structure. The casing bead is attached to the base structure before applying the base coat.

Two pieces of casing bead are attached to the base structure at spaced apart positions to provide boundaries for the banding feature. Successive coats of plaster material are applied to the wall to develop a main plane of the wall. The banding area projects above the main plane of the wall. In the area in which the main plane of the wall abuts the vertical portion of the L-shaped body of the casing bead, a craftsman must employ his skill and artistry to achieve a consistent and level surface. In the area between the pieces of casing bead, a reverse bend portion of the casing bead on the topmost edge of the vertical portion of the L-shaped body is used as a screed to define a level surface therebetween.

It should be noted that at this point, that the casing bead was not primarily designed for forming a banding feature on a plaster wall. The casing bead is designed to provide a "plastered in" edge around windows, doors and other open features. Since it was not designed to help produce a banding feature, such casing bead does not provide fast and efficient construction of banding features.

As noted above, a craftsman forming a banding feature must employ considerable skill and artistry to assure that the plaster in the plane of the wall abutting the casing bead is level and consistent. However, maintaining a level surface without a screed edge requires a great deal of time and effort. Since a banding feature may extend great linear distances along a wall surface, it is important to quickly and efficiently form such a feature to minimize the costs and inconsistencies involved in the final finished structure. As such, it would be desirable to provide a banding bead which would facilitate fast and efficient forming of banding features on structures.

OBJECTS AND SUMMARY OF THE INVENTION

A general object of the present invention is to provide a banding bead which provides screed edges at multiple levels to expedite the forming of a banding feature on structures.

Another object of the present invention is to provide a banding bead which includes support structures which support the banding bead relative to an underlying base structure.

A further object of the present invention is to provide a banding bead which can accommodate a variety of fasteners to attach the bead to an underlying base structure.

Briefly, and in accordance with the foregoing, the present invention envisions a banding bead which is attachable to a base structure providing a guide and form for retaining plaster or other plastic materials thereagainst at two different heights. The banding bead includes a base portion and a generally planar elongated support segment extending generally perpendicularly away said base portion. The banding bead is extruded from a selected material or formed from a strip of sheet material. The support segment has a first planar side, a second planar side, and a reverse bend portion distal the base portion. A screed lip is attached to and protrudes from the second planar side between the reverse bend portion and the base portion. The base portion includes primary and secondary feet extending from the support segment for attachment to the underlying base structure and to provide stability. The screed lip provides a screed surface for maintaining a desired wall thickness relative to a main wall plane and the reverse bend portion provides a screed surface for the surface of the banding feature a distance above the main wall plane.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which:

FIG. 1 is a partial fragmentary perspective view of two banding beads of the present invention employed to form an architectural band detail;

FIG. 2 is a partially fragmentary perspective view of one section of banding bead as shown in FIG. 1 in which the plaster has been removed;

FIG. 3 is a cross sectional side elevational view taken along line 3—3 in FIG. 1; and FIG. 4 is a partially fragmentary perspective view of an alternate embodiment of the banding bead of the present invention in which the banding bead is formed by folding a strip of suitable sheet material.

DETAILED DESCRIPTION OF THE INVENTION

While the invention may be susceptible to embodiment in different forms, there is shown in the drawings, and herein will be described in detail, embodiments of the present invention with the understanding that the present description is to be considered an exemplification of the principles of the invention and is not intended to limit the invention to that as illustrated and described herein.

Referring now to the drawings, wherein like parts are designated by the same reference numerals throughout the figures, a banding bead 20 in accordance with the present invention is shown in FIG. 1 and 2 attached to a base structure 22. As shown in FIGS. 1 and 2, the banding bead 20 is attached to the base structure 22 by means of staples 24 or screws 26. The base structure 22 typically includes lath material 28 attached to a stud 30.

The lath material 28 is a material such as metal lath of a known construction which is commonly used in the construction industry. An example of a specific type of a metal lath which may be used in this application can be found in U.S. Pat. No. 5,081,814 to Singletary et al. issued Jan. 21, 1992. Such lath 28 is typically an expanded metal product which provides spaces in which plaster is embedded to integrate the supporting lath attached to the studs or other frame structure with the plaster applied thereto as a unitary wall surface.

As shown in FIGS. 1 and 3, the stud 30 is a wooden stud. It should be noted, however, that metal studs are commonly used in the construction industry as well as other surfaces or frame structures to which the lath 28 is attached.

As shown in FIGS. 1–3, the banding bead 20 has a base portion 32 and a generally planar, elongated support segment 34 disposed thereon. The elongated support segment 34 extends generally perpendicularly away from said base portion 32. The support segment 34 has a first planar side 36 and a second planar side 38. A top screed portion 40 is disposed on the support segment 34 distal the base portion 32. The top screed portion 40 includes a reverse bend flange 41 which is embedded in plaster as shown in FIG. 3.

The base portion 32 includes stabilizing means 42 to perpendicularly stabilize the support segment 34 with respect to the base structure 22 and to provide an attachment interface between the support segment 34 and the base structure 22. The stabilizing means 42 includes a primary foot 44 extending perpendicularly away from the first planar side 36 of the support segment 34. A secondary foot 46 extends perpendicularly away from the second planar side 38 of the support segment 34 to provide further stability in the orientation of the support segment 34 with respect to the base structure 22. Both the primary and secondary feet 44, 46 are axially elongated generally parallel to the support segment 34.

The base portion 32, more specifically the primary foot 44, has a multiplicity of apertures 48 formed therethrough. The apertures 48 are provided in a variety of sizes and shapes to provide intimate engagement for a variety of fasteners which are used to mount the banding bead 20 to the base structure 22. Additionally, it is important to note that the multiplicity of apertures 48 provide an interface which receives plaster and allows the plaster to become embedded through the banding bead 20 thereby locking the bead into the plaster and making the bead and plaster integral with each other. Embedding of the plaster into the banding bead 20 increases the strength and durability of the finished wall. The embedding of the plaster in the apertures 48 can be seen in FIG. 3.

FIGS. 1 and 3 show a wall section 50 which has been cross sectioned such that the base structure 22 is shown with an attached banding bead 20. A main wall plane layer 52 of plaster material is built up along the second planar sides 38 of the two banding beads 20 shown in FIGS. 1 and 3. Between the banding beads 20, or against the first planar sides 36, a band layer 54 of plaster is built up. It is important to note that the main wall plane layer 52 has a thickness 56 which is different from the band layer 54 which has a thickness 58° The difference between the wall thickness 56 and the band thickness 58 defines the band height 60.

The band thickness 58 is maintained when a craftsman runs a darby or straight edge across the top screed portion 40 of two pieces of banding bead 20 as shown in FIGS. 1 and 3. The wall thickness 56 of the wall plane 52 is maintained by an intermediate screed lip 62 which is attached to the second planar side 38 between the top screed portion 40 and the base portion 32. The banding bead 20 can be formed in a variety of shapes to provide a screed lip 62 at a position between the top screed portion 40 and the base portion 32 to provide a desired wall thickness 56. The screed lip 62 provides substantial advantages over the prior art such that the screed lip 62 guides a straight edge for leveling the wall plane 52 and thus eliminates the need for precise, detailed positioning of a straight edge against the second planar side 38.

Additional plaster engaging surfaces are provided on the banding bead 20 by way of ribs 64 extending upwardly away from the primary foot 44. The ribs 64 as shown in FIG. 3 are formed at a rib angle 66 to provide greater engagement and embedding of the plaster with respect to the banding bead 20. Additionally, a protruding flange 68 may be provided on the first planar side 36 between the top screed portion 30 and the base portion 32. This protrusion 68 engages the plaster positioned thereagainst to further embed a portion of the banding bead 20 into the band layer 54 plaster. The protrusion 68 also provides an added degree of stiffening to the support segment 34 of the banding bead 20.

The banding bead 20 as shown in FIGS. 1–3 is a single piece body which is integrally formed through an extruding or other forming process. Materials which may be used for such an extruded or formed banding bead 20 might be PVC plastic, aluminum, galvanized steel, or any other material which is suitably rigid to act as a banding bead 20. It is anticipated that these banding beads 20 will be formed to specific lengths for production convenience. When a corner or other angular surface is encountered, the cut ends of the banding bead 20 may be mitered to be neatly formed around the corner. When specific lengths of the banding bead 20 are butted against each other, the abutting ends may be butted against each other and attached to the base structure 22 or the beads may be fastened by other means such as inserting a wire underneath the reverse bend flanges 41 of the top screed portion 40 thereby providing a fastening engagement between abutting edges.

FIG. 4 shows an alternate embodiment of the banding bead 20 as shown in FIGS. 1–3. Similar elements of the banding bead as shown in FIGS. 1–3 will be referred to with an alphabetic suffix to indicate the alternate embodiment. For example, the banding bead as shown in FIG. 2 will be designated as banding bead 20*a*.

The banding bead 20*a* as shown in FIG. 4 is formed from an elongated strip of a suitable foldable material. For example, a strip of zinc alloy metal could be used such that the zinc will provide sufficient corrosion resistance during the life of the banding bead. Also, a banding bead could be formed of a suitable nonmetallic material which is foldable such as PVC plastic or some other plastic material.

The banding bead 20*a* has an elongated support portion 34*a* which has a first planar side 36*a*, a second planar side 38*a*, and a top screed portion 40*a*. The strip of sheet material used to form the banding bead 20*a* has a first edge 70 and a second edge 72. One side of the strip material is defined between the first edge and second edge 70, 72 as the first face 74, the second side of the strip material between the first edge and second edge 70, 72, opposite the first face 74, is designated as the second face 76. When the banding bead 20*a* is formed from the strip material, the first face 74 generally corresponds to the first planar side 36*a* and the second planar side 38*a*includes a portion of the first face 74 and the second face 76. A primary segment 80 of the support portion 34*a* extends between the base portion 32 and top screed portion 40*a*. A secondary segment 82 extends between the base portion 32 and the screed lip 62*a*.

When the banding bead 20*a* is formed of the foldable material as shown in FIG. 4, it may be necessary to attach the primary segment 80 to the secondary segment 82 to prevent the two segments 80, 82 from separating. In this regard, an attachment fastener 84 is attached to the segments 80,82 to secure the segments 80,82 to each other.

In use, the banding bead 20 of the present invention is attached to a base structure 22. The lath 28 of the base structure 22 can be positioned underneath the stabilizing means 42 or maybe laid over the stabilizing means 42.

With the banding bead 20 attached to the support structure 22, a scratch coat 86 is applied over a facing surface of the base portion 32 and the lath 28. The scratch coat is worked into openings in the lath 28 and the apertures 48 of the base portion 32. The plaster of the scratch coat 86 is thoroughly embedded to provide integral engagement of the plaster surfaces with the banding bead 20 and the lath 28. Next, a wall plane 52 is built up with a plaster material in a plastic state. A "brown coat" is applied to the scratch coat and the finish coat is applied over the brown coat to a desired thickness as determined by the wall thickness 56. The screed lip 62 provides the leveling edge to assure that the wall thickness 56 is at a desired predetermined dimension. The band thickness 58 is built up by working plaster material between the banding beads 20. The banding layer 54 is surfaced by working a straight edge across the top screed portion 40 of the banding bead 20.

While preferred embodiments of the present invention have been shown and described, it is envisioned that those skilled in the art may devise various modifications of the present invention without departing from the spirit and scope of the appended claims. The invention is not intended to be limited by the foregoing disclosure.

The invention claimed is:

1. A banding bead attachable to a base structure for providing a guide and form for retaining plaster or other plastics thereagainst at two different heights, said banding bead comprising:

an axially elongated base portion for stabilizing said banding bead, said base portion being attachable to a base structure;

a generally planar, axially elongated support segment attached to and extending generally perpendicularly away from said base portion generally intermediate opposed elongated edges of said base portion, said support segment having a first planar side, a second planar side, and a top screed portion attached to said support segment distal said base portion, said top screed portion providing a reference edge for an upper plane of plaster adapted to abut said first planar side; and a continuous, axially elongated intermediate screed lip attached to said second planar side of said support segment between said top screed portion and said base portion, said screed lip protruding from said second planar side, said intermediate screed lip providing a reference edge for a lower plane of plaster adapted to abut said second planar side.

2. A banding bead as recited in claim 1, wherein said base portion includes an axially elongated primary foot attached to said support segment, said primary foot protruding generally perpendicularly away from said support segment.

3. A banding bead attachable to a base structure for providing a guide and form for retaining plaster or other plastics thereagainst at two different heights, said banding bead comprising:

an axially elongated base portion for stabilizing said banding bead, said base portion being attachable to said base structure;

a generally planar, axially elongated support segment attached to and extending generally perpendicularly away from said base portion, said support segment having a first planar side, a second planar side, and a top screed portion attached to said support segment distal said base portion, said top screed portion providing a reference edge for an upper plane of plaster adapted to abut said first planar side;

a primary foot protruding generally perpendicularly away from said support segment, said primary foot having a multiplicity of apertures formed therein, said apertures adapted to receive plastics material therein to integrate said banding bend into a finished wall structure; and a continuous, axially elongated intermediate screed lip attached to said second planar sade of said support segment between said top screed portion and said base portion, said screed lip protruding from said second planar side, said intermediate screed lip providing a reference edge for a lower plane of plaster adapted to abut said second planar side.

4. A banding bead as recited in claim 3, further including said apertures having a variety of configurations and dimensions for accommodating a variety of fasteners to secure said banding bead to a base structure.

5. Amended) A banding bead attachable to a base structure for providing a guide and form for retaining plaster or other plastics thereagainst at two different heights, said banding bead comprising:

an axially elongated base portion for stabilizing said banding bead a generally planar, axially elongated support segment attached to and extending generally perpendicularly away from said base portion, said support segment having a first planar side, a second planar side, and a top screed portion attached to said support segment distal said base portion, said top screed portion providing a reference edge for an upper plane of plaster adapted to abut said first planar side;

said base portion including an axially elongated primary foot attached to said support segment, said primary foot extending away from said first planar side of said support an axially elongated secondary foot attached to and extending generally perpendicularly away from said second planar side of said support segment; and a continuous, axially elongated intermediate screed lip attached to said second planar side of said support segment between said top screed portion and said base portion, said screed lip protruding from said second planar side, said intermediate screed lip providing a reference edge for a lower plane of plaster adapted to abut said second planar side.

6. A banding bead attachable to a base structure for providing a guide and form for retaining plaster or other plastics thereagainst at two different heights, said banding bead comprising:

an axially elongated base portion for stabilizing said banding bead, said base portion being attachable to a base structure;

a generally planar, axially elongated support segment attached to and extending generally perpendicularly away from said base portion, said support segment having a first planar side, a second planar side, and a top screed portion attached to said support segment distal said base portion, said top screed portion providing a reference edge for an upper plane of plaster adapted to abut said first planar side;

a continuous, axially elongated intermediate screed lip attached to said second planar side of said support segment between said top screed portion and said base portion, said screed lip protruding from said second planar side, said intermediate screed lip providing a reference edge for a lower plane of plaster adapted to abut said second planar side; and at least one protrusion on said banding bead extending from said first planar side for engaging and retaining plastics material in engagement with said banding bead.

7. A banding bead as recited in claim 2, further comprising as least one axially elongated rib on said base portion of said banding bead for engaging and retaining plastic material in engagement with said base portion of said banding bead.

8. A banding bead attachable to a base structure for providing a guide and form for retaining plaster or other plastics thereagainst at two different heights, said banding bead comprising:

an axially elongated base portion for stabilizing said banding bead, said base portion being attachable to a base structure;

a generally planar, axially elongated support segment attached to and extending generally perpendicularly away from said base portion, said support segment having a first planar side, a second planar side, and a top screed portion attached to said support segment distal said base portion, said top screed portion providing a reference edge for an upper plane of plaster adapted to abut said first planar side;

said base portion includes an axially elongated primary foot attached said support segment, said primary foot protruding generally perpendicularly away from said support segment, at least one axially elongated ribbon said base portion for engaging and retaining plastic adapted to retain plastics material in engagement with said base portion, said at least one rib being angled toward said first planar side of said support segment; and a continuous, axially elongated intermediate screed lip attached to said second planar side of said support segment between said top screed portion and said base portion, said screed lip protruding from said second planar side, said intermediate screed lip providing a reference edge for a lower plane of plaster adapted to abut said second planar side.

9. A banding bead as recited in claim 1, wherein said intermediate screed lip is positioned on said second planar side of said support segment substantially midway between said top screed portion and said base portion 10. A banding bead as recited in claim 1, wherein said banding bead is a single piece unitary body, said banding bead being extruded from a suitable material.

11. A banding bead as recited in claim 1, wherein said banding bead is formed from an elongated strip of a suitable foldable material.

12. A banding bead attachable to a base structure for providing a guide and form for retaining plaster or other plastics thereagainst at two different heights, said banding bead being formed of a folded sheet strip, said sheet strip having a first face and a second face, said first and second faces defining a first elongated edge and a second elongated edge, said banding bead comprising:

an axially elongated base portion for attaching said banding bead to a base structure and stabilizing said banding bead;

a generally planar, axially elongated support segment depending from said base portion generally intermediate opposed elongated edges of said base portion, said support segment having a first planar side, a second planar side, a top screed portion terminating in said first edge formed on said support segment distal said base portion, said top screed portion providing a reference edge for defining an upper plane of plaster adapted to abut said first planar side;

an axially elongated intermediate screed lip proximate said second planar side of said support segment, said intermediate screed lip being positioned between said top screed portion and said base portion, said intermediate screed lip providing a reference edge for a lower plane of plaster adapted to abut said second planar side.

13. A banding bead attachable to a base structure for providing a guide and form for retaining plaster or other plastics thereagainst at two different heights, said banding bead being formed of a folded sheet strip, said sheet strip having a first face and a second face, said first and second faces defining a first elongated edge and a second elongated edge, a portion of said sheet strip defining said first planar side and a portion of said sheet strip defining said second planar side are attached for preventing said first and second planar sides from separating, said banding bead having a base portion for attaching said banding bead to a base structure and stabilizing said banding bead; a generally planar, elongated support segment depending from said base portion, said support segment having a first planar side, a second planar side, a top screed portion terminating in said first edge formed on said support segment distal said base portion; a screed lip proximate said second planar side of said support segment, said screed lip being disposed between said top screed portion and said base portion.

14. A banding bead as recited in claim 13, wherein said banding bead is formed of a suitable metallic strip material.

15. A banding bead attachable to a base structure for providing a guide and form for retaining plaster or other plastics thereagainst at two different heights, said banding bead being formed of a folded sheet strip, said sheet strip having a first face and a second face, said first and second faces defining a first elongated edge and a second elongated edge, said banding bead comprising:

an axially elongated base portion for attaching said banding bead to a base structure and stabilizing said banding bead;

a generally planar, axially elongated support segment depending said base portion, said support segment having a first planar side, a second planar side, a top screed portion terminating in said first edge formed on said support segment distal said base portion, said top screed portion providing a reference edge for defining an upper plane of plaster adapted to abut said first planar side;

an axially elongated intermediate screed lip proximate said second planar side of said support segment, said intermediate screed lip being positioned between said top screed portion and said base portion, said intermediate screed lip providing a reference edge for a lower plane of plaster adapted to abut said second planar side;

at least one protrusion attached to said first planar side of said banding bead between said top screed portion and said base portion adapted to retain plastics material in engagement with said banding bead.

16. In combination, a banding bead attachable to a base structure, said base structure receiving a plaster material for forming a plaster surface, said banding bead providing a guide and form for retaining plaster or other plastics on said base structure at two different heights, said banding bead comprising:

an axially elongated base portion for stabilizing said banding bead, said base portion being attachable to a base structure;

a generally planar, axially elongated support segment attached to and extending generally perpendicularly away from said base portion, said support segment having a first planar side, a second planar side, and a top screed portion attached to said support segment distal said base portion, said top screed portion providing a reference edge for defining an upper plane of plaster abutting said first planar side, plaster being retained against said first planar side at a height generally equal to a dimension measured between said base structure and said top screed portion; and a continuous, axially elongated intermediate screed lip attached to said second planar side of said support segment between said top screed portion and said base portion, said screed lip protruding from said second planar side, said intermediate screed lip providing a reference edge defining a lower plane of plaster abutting said second planar side, plaster being retained against said second planar side at a height generally equal to a dimension measured between said base structure and said intermediate screed lip.

17. A combination of a banding bead and a base structure as recited in claim 16, wherein said intermediate screed lip is positioned on said second planar side of said support segment substantially midway between said top screed portion and said base structure.

18. A combination of a banding bead and a base structure as recited in claim 16, wherein said top screed portion extends from said first planar side of said support segment and said intermediate lip extends oppositely from said second planar side of said support segment, said top screed portion and intermediate screed lip generally perpendicularly extend away from said respective first and second planar sides.

19. A banding bead as recited in claim 1, wherein said top screed portion extends from said first planar side of said support segment and said intermediate lip extends oppositely from said second planar side of said support segment, said top screed portion and intermediate screed lip generally perpendicularly extend away from said respective first and second planar sides.

* * * * *

UNITED STATES PATENT AND TRADEMARK OFFICE

CERTIFICATE OF CORRECTION

PATENT NO. : 5,423,154

DATED : June 13, 1995

INVENTOR(S) : Gary J. Maylon and John D. Straub

It is certified that error appears in the above-indentified patent and that said Letters Patent is hereby corrected as shown below:

Column 4, Line 30 _ "thickness 58° " should read --thickness 58. --

Column 6, Line 62 "bend" should read -- bead --

Column 6, Line 65 "sade" should read --side --

Column 7, Line 7 "Amended) A" should read --A --

Column 7, Line 25 "support" should read --support segment; --

Column 8, Line 18 "attached said" should read -- attached to said --

Column 8, Line 21 "ribbon said" should read --rib on said --

Signed and Sealed this

Fifth Day of September, 1995

*Attest:*

*Attesting Officer*

Bruce Lehman

BRUCE LEHMAN

*Commissioner of Patents and Trademarks*